United States Patent [19]

Griesdorn

[11] Patent Number: 4,733,518

[45] Date of Patent: Mar. 29, 1988

[54] APPARATUS FOR PACKAGING ARTICLES AND METHOD OF MAKING SUCH APPARATUS

[75] Inventor: Carl P. Griesdorn, Cincinnati, Ohio

[73] Assignee: Planet Products Corporation, Cincinnati, Ohio

[21] Appl. No.: 739,247

[22] Filed: May 30, 1985

[51] Int. Cl.[4] ..... B65B 19/34

[52] U.S. Cl. ..... 53/444; 53/473; 53/148; 53/534; 53/251

[58] Field of Search ..... 53/148, 154, 236, 248, 53/250, 251, 444, 473, 534, 247, 249, 253, 542, 543; 198/382, 396, 480.1, 699.1, 481.1, 803.14; 156/542

[56] References Cited

U.S. PATENT DOCUMENTS

| | | | |
|---|---|---|---|
| 2,045,767 | 6/1936 | Funk | 53/473 |
| 2,155,088 | 4/1939 | Hopkins | 198/480.1 X |
| 2,757,778 | 8/1956 | Lyons | 198/481.1 |
| 3,152,684 | 10/1964 | Shields | 198/481.1 X |
| 3,157,271 | 11/1964 | Peterson | 198/803.14 X |
| 3,354,613 | 11/1967 | Anderson et al. | 53/251 |
| 3,445,986 | 5/1969 | Godet | 53/148 |
| 3,470,674 | 10/1969 | Madonia | 53/251 X |
| 3,717,236 | 2/1973 | New | 198/480.1 X |
| 3,850,289 | 11/1974 | Behr et al. | 198/382 |
| 3,948,711 | 4/1976 | Piatek | 156/542 X |
| 3,981,394 | 9/1976 | Slathar et al. | 53/154 X |
| 4,149,355 | 4/1979 | Clegg | 53/154 X |
| 4,344,523 | 8/1982 | May et al. | 53/148 X |
| 4,386,490 | 6/1983 | Griffith et al. | 53/148 |
| 4,421,222 | 12/1983 | Stuermer | 198/396 X |
| 4,433,526 | 2/1984 | Nord | 53/247 X |
| 4,462,508 | 7/1984 | Grafius | 198/396 X |

*Primary Examiner*—Robert L. Spruill
*Assistant Examiner*—Steven P. Weihrouch
*Attorney, Agent, or Firm*—Kinney & Schenk

[57] ABSTRACT

An apparatus for packaging articles of roughly equal size in package means therefor and method of making such apparatus are provided wherein such apparatus comprises a first conveyor device for the articles with the first conveyor device having a plurality of receptacles each for receiving and supporting an individual one of the articles, a second conveyor device for moving a plurality of packages for the articles, and a transfer device for transferring a predetermined number of the articles from the first conveyor device into associated packages therefor wherein the first and second conveyor devices have portions thereof in parallel facing relation and the apparatus further comprises a drive for operating the conveyor devices in a continuous non-indexing manner to thereby continuously package the predetermined number of articles in an associated package. In accordance with another feature of this invention the apparatus comprises an improved transfer device in the form of a rotatable star wheel and cooperating stationary fingers with the star wheel having a plurality of radial arms which are adapted to extend through selected fingers and cooperate therewith to transfer articles.

32 Claims, 10 Drawing Figures

APPARATUS FOR PACKAGING ARTICLES AND METHOD OF MAKING SUCH APPARATUS

BACKGROUND OF THE INVENTION

1. Field of the Invention

This invention relates to an apparatus for packaging articles of roughly equal size in package means therefor and to a method of making such apparatus.

2. Prior Art Statement

It is known in the art to provide an apparatus for packaging articles such as sausages or other similar cylindrical food products of roughly equal size in packages therefor and comprising a first conveyor device for the articles with the first conveyor device having a plurality of receptacles each for receiving and supporting an individual one of the articles, a second conveyor device for moving a plurality of packages for the articles, and a transfer device for transferring a predetermined number of the articles from the first conveyor device into an associated package; and, an apparatus of this general type is disclosed in U.S. Pat. No. 4,344,523 which utilizes complicated indexing conveyor devices which cooperate with a complex transfer device to package articles in stacked relation in associated packages therefor.

It is also known in the art, as disclosed in U.S. patent application Ser. No. 292,741, now U.S. Pat. No. 4,421,222 for example, to provide an apparatus which utilizes a plurality of conveyors for arranging articles of roughly equal size in aligned end-to-end relation.

However, the need exists for providing apparatus for packaging articles of roughly equal size in associated packages therefor in a continuous and efficient manner.

However, the apparatus disclosed in the above-mentioned patent and application are deficient in that each is comparatively complex, expensive, and basically not capable of packaging articles (such as fresh tender food products) of roughly equal size in associated package means therefor with optimum efficiency yet gently and in a minimum of time.

SUMMARY OF THE INVENTION

This invention provides an improved apparatus for packaging articles of roughly equal size in package means therefor and method of making such apparatus which overcome the above-mentioned deficiencies. In particular, such apparatus comprises a first conveyor device for the articles with the first conveyor device having a plurality of receptacles each for receiving and supporting an individual one of the articles, a second conveyor device for moving a plurality of packages for the articles, and a transfer device for transferring a predetermined number of the articles from the first conveyor device into an associated package.

In adcordance with one embodiment of this invention the first and second conveyor devices have portions thereof in parallel facing relation and the apparatus further comprises a drive for operating the conveyor devices in a continuous non-indexing manner to thereby continuously package the predetermined number of articles in an associated package.

In accordance with another embodiment of the invention the transfer device comprises a rotatable star wheel and cooperating stationary fingers with the star wheel having a plurality of radial arms which are adapted to extend through selected fingers and cooperate therewith to transfer articles.

Accordingly, it is an object of this invention to provide an improved apparatus of the character mentioned.

Another object of this invention is to provide an improved method of making an apparatus of the character mentioned.

Other features, objects, uses, and advantages of this invention are apparent from a reading of this description which proceeds with reference to the accompanying drawings forming a part thereof.

BRIEF DESCRIPTION OF THE DRAWINGS

The accompanying drawings show present preferred embodiments of this invention, in which.

DETAILED DESCRIPTION

Figure 1:
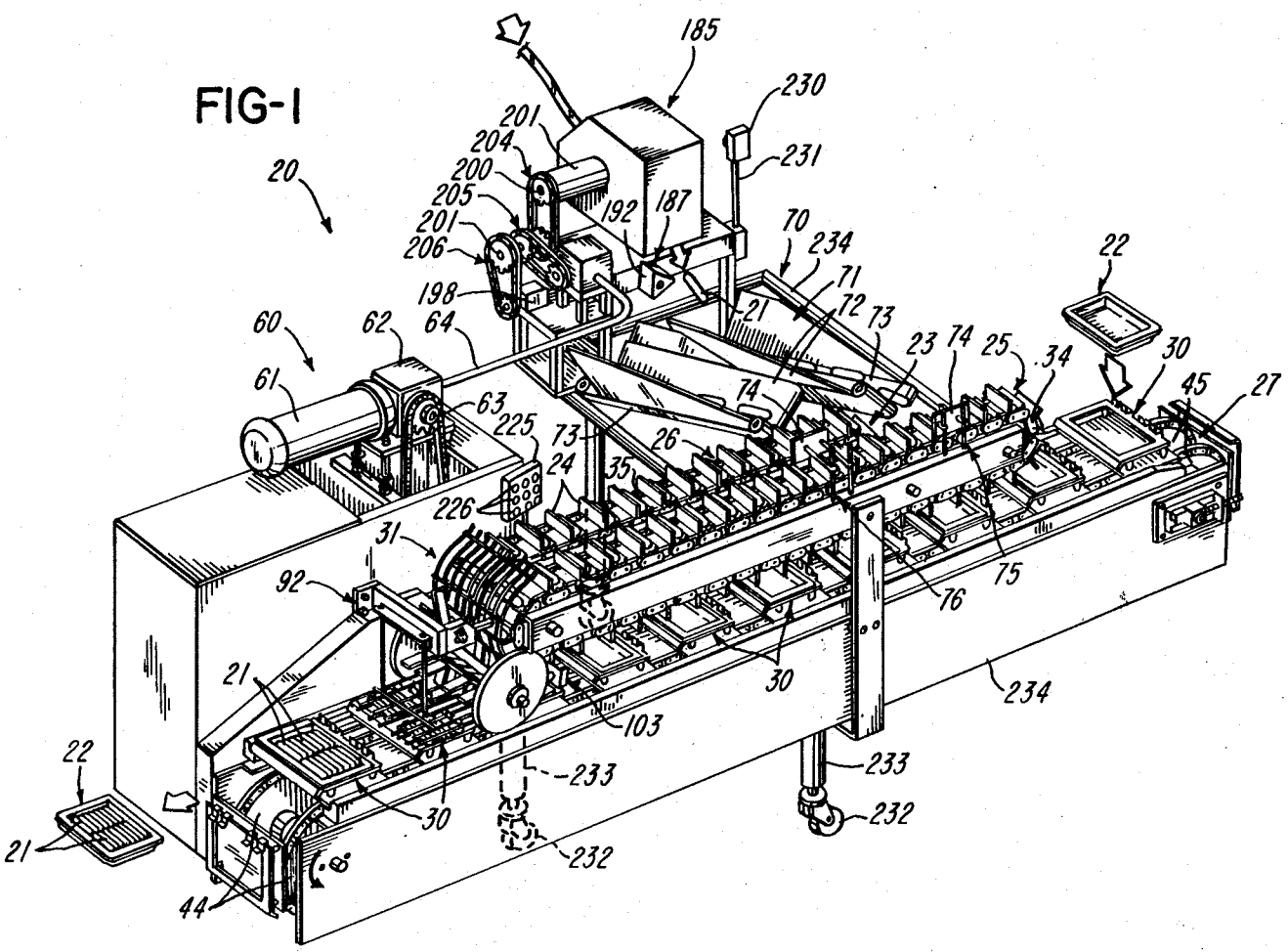
FIG. 1 is an isometric view of an apparatus of this invention for packaging articles of roughly equal size in package means therefor which comprises first and second conveyor devices, a transfer device between the conveyor devices, and also showing feed means for the articles including article supply means shown as means for forming such articles.

Reference is now made to FIG. 1 of the drawings which illustrates one exemplary embodiment of the apparatus of this invention which is designated generally by the reference numeral 20. The apparatus 20 is provided for packaging articles which are designated generally by the reference numeral 21 and are of roughly equal size and with only a few representative ones of such articles being thus designated in associated package means or packages 22 therefor.

The apparatus 20 is particularly adapted to handle articles 21 such as fresh tender food products 21 for human consumption and which may be in the form of fresh pork sausage links, potato croquettes, fish sticks, zucchini sticks, and the like. The food products 21 may be of the types used in hotels, restaurants, or institutions; and, although such products 21 of this example are shown as being roughly cylindrical in shape it will be appreciated that such products may be of any suitable shape including rectangular, square, oblong, and the like.

For ease of description the food products 21 will be referred to hereinafter as simply articles 21 and such articles may be fresh perishable tender articles which must be handled carefully so as not to cause breakup thereof. In many applications such articles are made so that they have an average body temperature generally of the order of 25° to 35° F. Further, the apparatus 20 generally is operated in a controlled ambient environment of about 40° F. for example. With control of the temperature of the articles 21 and the ambient environment as indicated the objective is to form and package articles 21 in a total cycle time generally between 20 to 30 seconds. A cycle time of this magnitude will minimize any tendency for bacteria buildup, or the like, during processing of the articles 21.

As seen in FIG. 1, the apparatus 20 comprises first conveyor means in the form of a first conveyor device 23 having a plurality of receptacles 24 each for receiving and supporting an individual one of the articles 21. The receptacles 24 of the conveyor device 23 comprises a plurality of parallel receptacles disposed in a plurality of two parallel rows 25 and 26 and with associated receptacles 24 in the two rows 25 and 26 being disposed in aligned end-to-end relation.

The apparatus 20 also comprises second conveyor means in the form of a second conveyor device 27 for moving a plurality of package means or packages 22 for the articles 21. The packages 22 are supported in associated carriers 30 and the conveyor device 27 and carriers 30 will be described in more detail subsequently.

Figure 2:
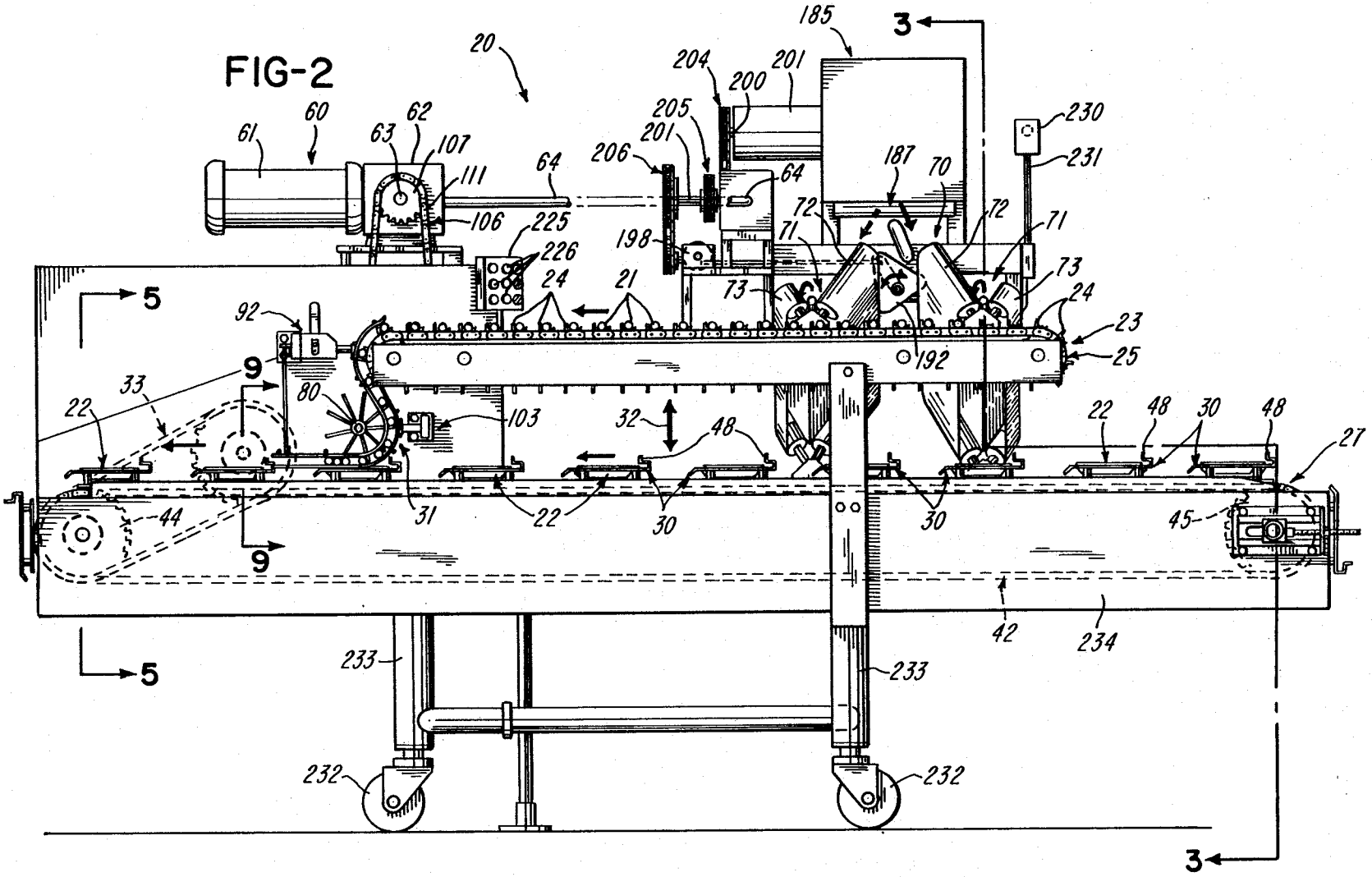
FIG. 2 is a view in elevation of the apparatus of FIG. 1.
Figure 6:
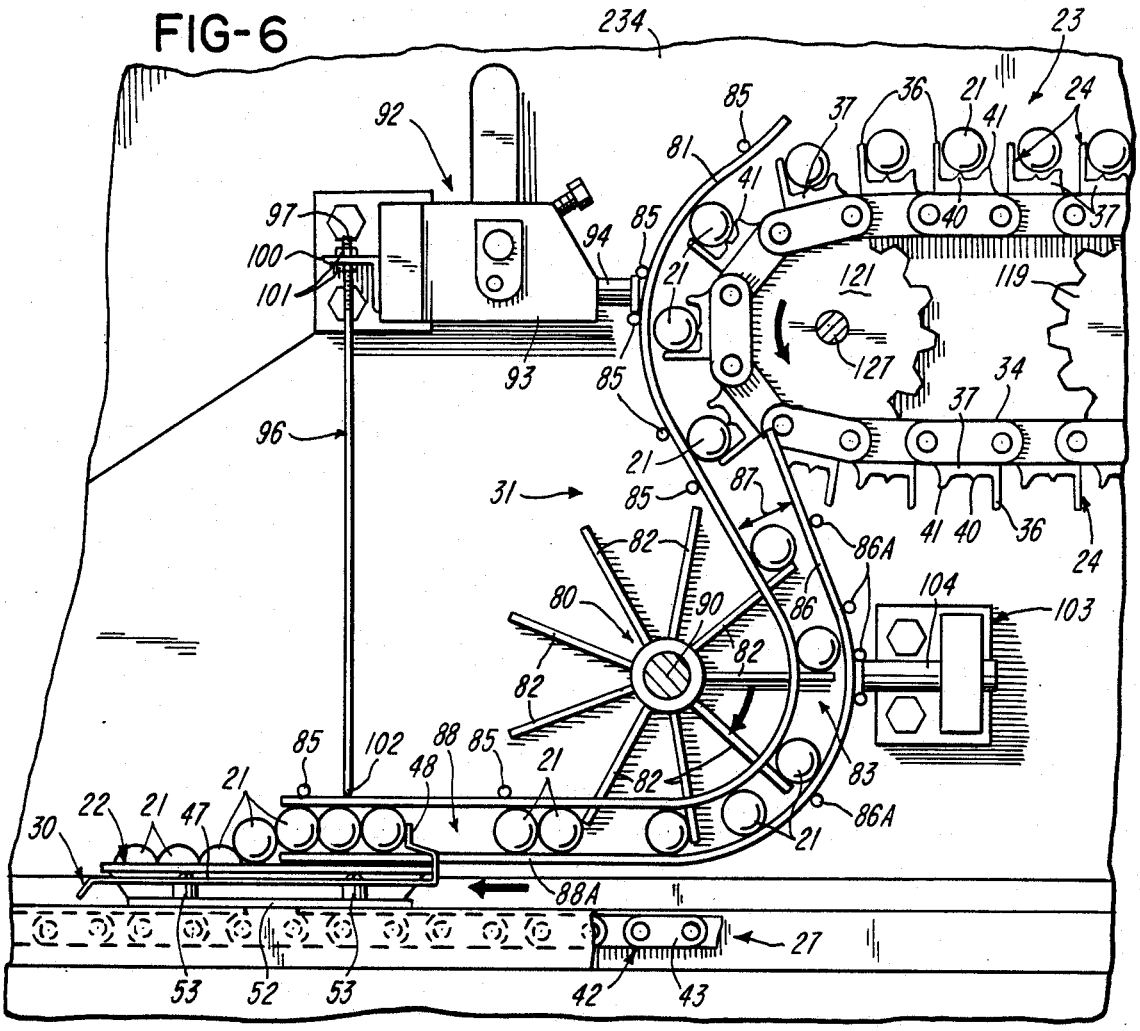
FIG. 6 is a view taken essentially on the line 6—6 of FIG. 5.

The apparatus 20 also has a transfer means, which is best shown in FIG. 6, and such transfer means or transfer device is designated generally by the reference numeral 31. The transfer device 31 is provided for transferring a predetermined number of the articles 21 from the first conveyor device 23 to the second conveyor device 27 and into associated packages 22 therefor. In accordance with the teachings of this invention the first and second conveyor devices 23 and 27 have portions thereof in parallel facing relation and as shown by the double arrow at 32 in FIG. 2; and, the apparatus 20 also comprises drive means 33 for operating the conveyor devices 23 and 27 in a continuous non-indexing manner to thereby continuously package a predetermined number of articles 21 in an associated package 22 therefor. As will be readily apparent, particularly from FIG. 2, the conveyor devices 23 and 27 have the facing portions thereof disposed in parallel horizontal relation; and, in this example, the referred to portion of the conveyor device 23 consists of the entire conveyor device 23 which is disposed vertically above the referred to portion of the conveyor device 27. The referred to portion of the conveyor device 27 is the main part of the central portion of such conveyor device 27.

As previously mentioned the apparatus 20 comprises the transfer device 31 and such transfer device, in essence, transfers a predetermined number of articles 21 into a planar relation in an associated package 22 therefor and as shown at tne left hand side of FIG. 1. In particular, the transfer device 21 of this example transfers the articles 21 from the first or upper conveyor device 23 to the second or lower conveyor device 27 through an essentially vertical path of travel, which will be described subsequently, and into packages 22 carried on the carriers 30 comprising the second conveyor device 27. It will also be seen that because the conveyor device 23 has receptacles 24 arranged in parallel rows 25 and 26 the articles 21 received in each package 22 are disposed not only in planar relation but in two side-by-side rows with associated articles in rows 25–26 being aligned end-to-end.

Referring again to FIG. 1 it will be seen that the conveyor device 23 comprises a first chain conveyor device or sprocket chain assembly 34 and a second chain conveyor device or sprocket chain assembly 35. The plurality of parallel receptacles 24 are disposed in the two parallel rows 25 and 26, as mentioned earlier, with row 25 being associated with assembly 34 and row 26 being associated with assembly 35. The receptacles 24 in rows 25 and 26 are disposed and supported by the sprocket chain assemblies 34 and 35 respectively.

Each receptacle 24 is a roughly L-shaped support or support cradle 24 and as best seen in FIG. 6 each cradle has a pair of legs defined by a first substantially planar leg 36 and a second leg 37. The leg 37 has an integral ridge 40 which is disposed parallel to the legs 36 and 37 and the ridge 40 in this example is disposed substantially midway between the inner end of its leg 37 and the outer end thereof. The ridge 40 serves to help minimize the amount of contact between an article 21 and the leg 37 such that as the receptacle or cradle 24 moves toward the transfer means 31 each article 21 will tend to move away from its cradle 24 in a non-clinging manner.

It will be appreciated that especially in applications where each article 21 is a fresh tender food product there is a normal tendency for such a tender food product to sag and provide maximum contact with its leg 37. The ridge 40 assures that there is minimum contact between each article 21 and its leg 37.

The leg 37 also has a protrusion 41 at the terminal outer end thereof which assures that an article 21 received within the cradle 24 will tend to be retained on the leg 37 of such cradle. The protrusion 41 may extend any desired amount from its leg 37 and preferably has a rounded tip, as shown.

The articles 21 of this example of the invention are elongate articles; and, each of such articles has a longitudinal axis disposed parallel to the longitudinal axis of its L-shaped support or cradle 24. The axis of each cradle 24 is disposed perpendicular to the direction of movement of the conveyor device 23 whereby the articles 21 are moved while supported with their axes perpendicular to such direction of movement.

Figure 8:
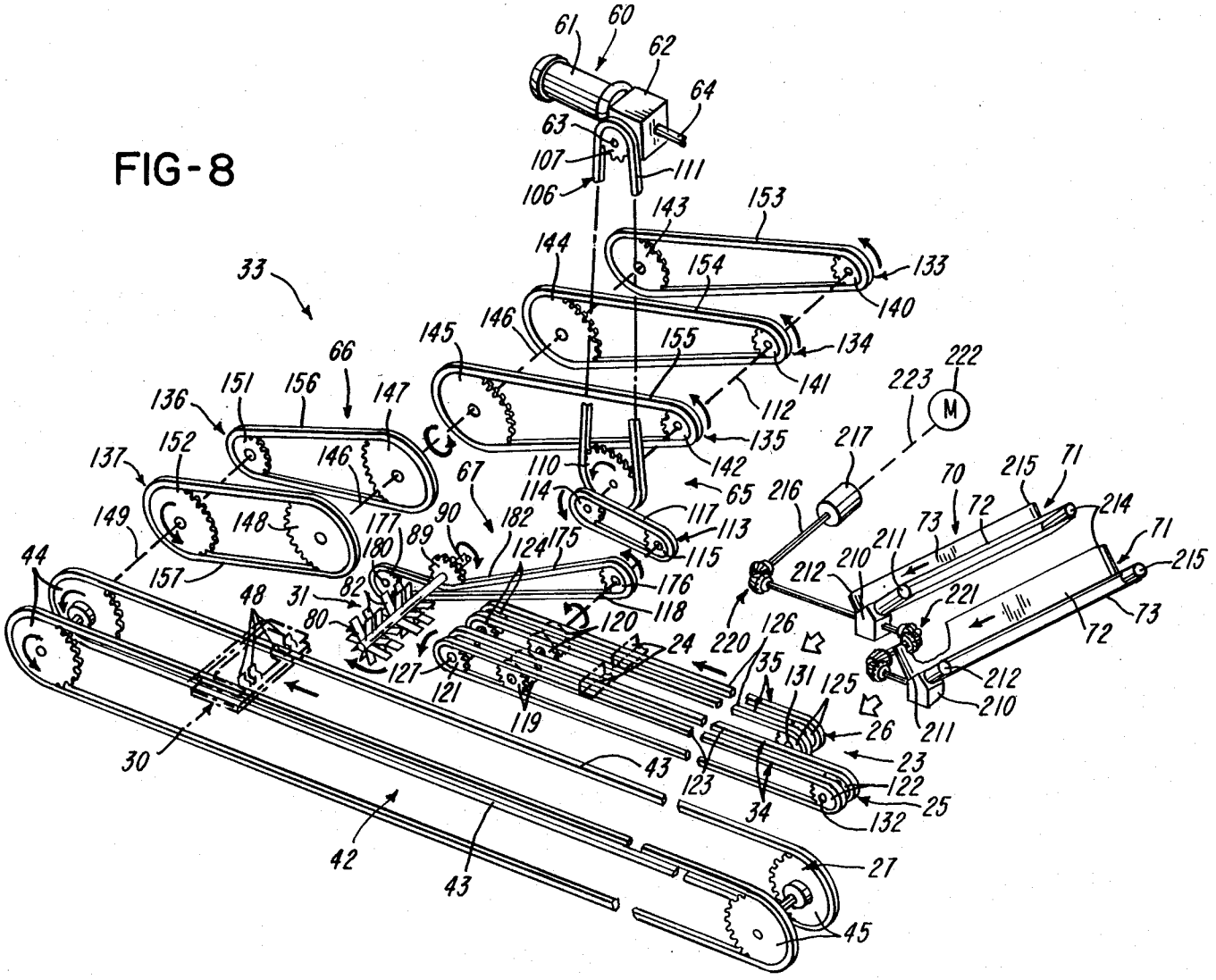
FIG. 8 is an isometric view particularly illustrating drive means for the apparatus of this invention.

As best seen in FIG. 8, the conveyor device 27 is in the form of a single sprocket chain assembly 42 having a pair of sprocket chains each designated by the same reference numeral 43 and associated sprockets 44 at one end and sprockets 45 at the opposite end. The sprocket chain assembly 42 has the previously mentioned plurality of spaced carriers 30 attached thereto in equally spaced relation for movement therewith. Each of the carriers 30 is adapted to carry an associated one of the packages 22 therewithin.

Figure 7:
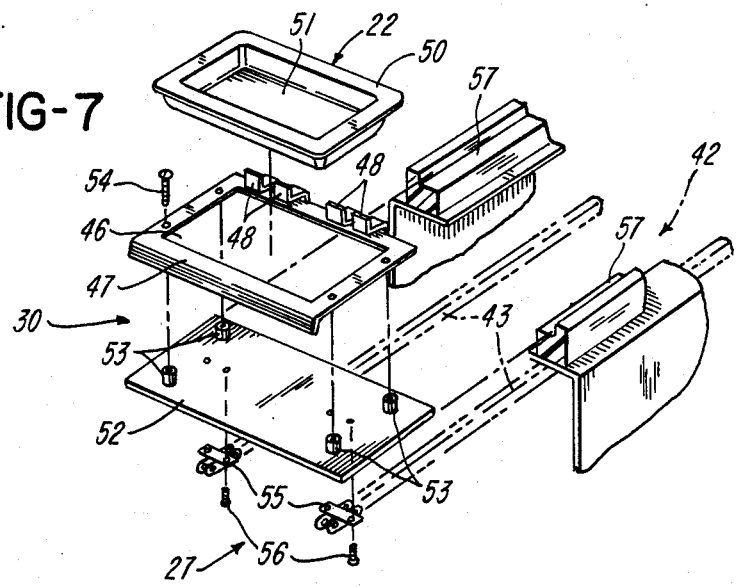
FIG. 7 is an exploded isometric view particularly illustrating portions of the second conveyor device and a typical carrier comprising the second conveyor device together with a package adapted to be carried by the carrier.

In particular, it will be seen that each carrier 30 has a cutout 46 (See FIG. 7) therein which is adapted to receive an associated package 22 in nested relation therewithin. Each carrier 30 also has a planar annular ledge-like portion 47 surrounding the cutout 46 and a plurality of pusher fingers 48 fixed to one side of ledge 47 in spaced relation for pushing articles 21 into an associated package carried by the carrier 30.

Each ledge-like portion or ledge 47 of carrier 30 is particularly adapted to receive thereon a peripheral flange 50 surrounding a peripheral vertical wall comprising the main body portion 51 of an associated package 21. The flange 50 is adapted to engage and be supported by the ledge-like portion 47, whereby the entire package or tray 22 is supported by its carrier 30.

Each carrier 30 also has a bottom portion or bottom support plate 52 which is provided with a plurality of internally threaded columnar members or washers 53 suitably fixed thereto in upstanding relation from the top surface of the plate 52. The threaded washers 53 are adapted to support the ledge-like portion 47 in spaced relation above the support plate 52 and threaded screws 54 are used to attach the ledge-like portion 47 on its associated plate 52.

The carriers 30 of this example are attached at their opposite sides to the sprocket chains 43 of the assembly 42 using attachment members 55 which comprise associated sprocket chains 43. Threaded bolts 56 are provided and extend through associated openings in the members 55 and are threadedly received in associated threaded openings in the plate 52. In this manner, the carriers 30 are attached to and comprise the conveyor device 27.

Figure 5:
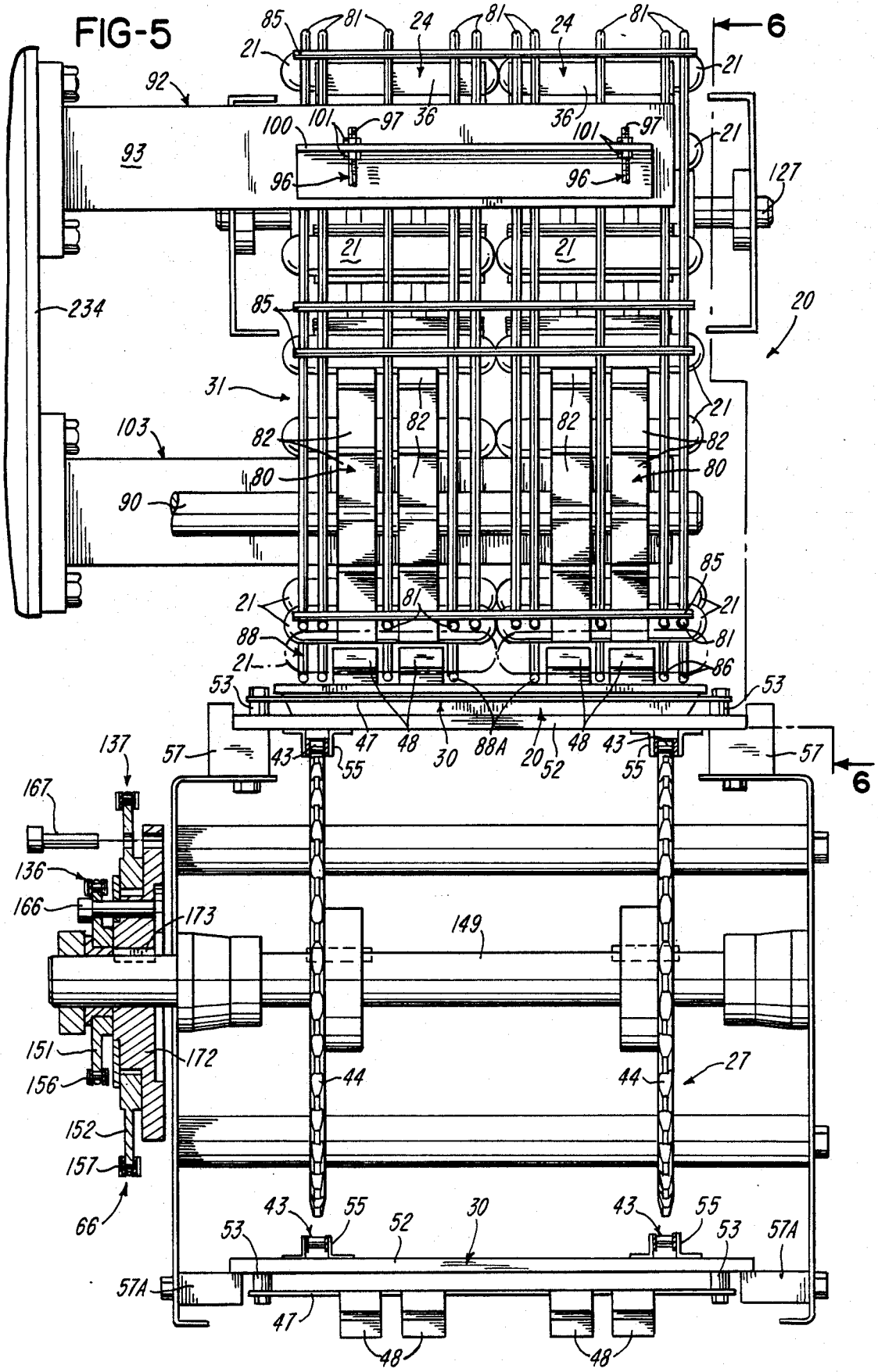
FIG. 5 is a view taken essentially on the line 5—5 of FIG. 2.

The conveyor device 27 has a pair of horizontal top slides 57 (FIG. 7) supported in spaced apart parallel relation and each disposed above the top flight of an associated sprocket chain 43. The slides 57 are adapted to support the bottom surfaces of the plates 52 and hence carriers 30; and, with the plates 52 attached to the sprocket chains 43 in the manner previously described the outer opposed bottom sides of the plates 52 are such that once the sprocket chains 43 are moved the support plates 32 and hence the carriers 30 are slid along the slides 57. As seen in FIG. 5, a pair of bottom slides 57A are provided and each similarly disposed beneath the bottom flight of an associated sprocket chain 43 for slideably supporting the carriers 30 beneath their conveyor device 27. The slides 57 and 57A are detachably supported in position in a high strength manner on the apparatus 20 and such slides 57 and 57A are made of suitable antifriction material to enable easy sliding of the carriers 30 therealong once the conveyor device 27 is operated.

As previously mentioned the apparatus 20 comprises drive means 33 for operating the conveyor devices 23 and 27 in a continuous non-indexing manner. The drive means 33 is best illustrated in FIG. 8 of the drawings and such drive means 33, of this example, preferably comprises a main drive in the form of a single drive assembly or drive 60. The drive assembly 60 may comprise any suitable motor 61; however, it preferably comprises an electric motor 61 and a gear box 62 provided with an output shaft 63 extending in one direction from the gear box and an output shaft 64 extending in another direction from such gear box 62.

The drive means 33 includes drive connections 65 (FIG. 8) from the drive 60 and in particular from shaft 63 thereof extending to the conveyor device 23, drive connections 66 from the drive 60 to the conveyor device 27, and drive connections 67 from the drive 60 to the transfer means 31. The drive means 33 include means for operating not only the conveyor devices 23 and 27 in a continuous non-indexing manner, but also the transfer means or device 31 in a continuous nonindexing manner. The drive connections 65, 66, and 67 which comprise the drive means 33 will be described in more detail subsequently.

Figure 3:
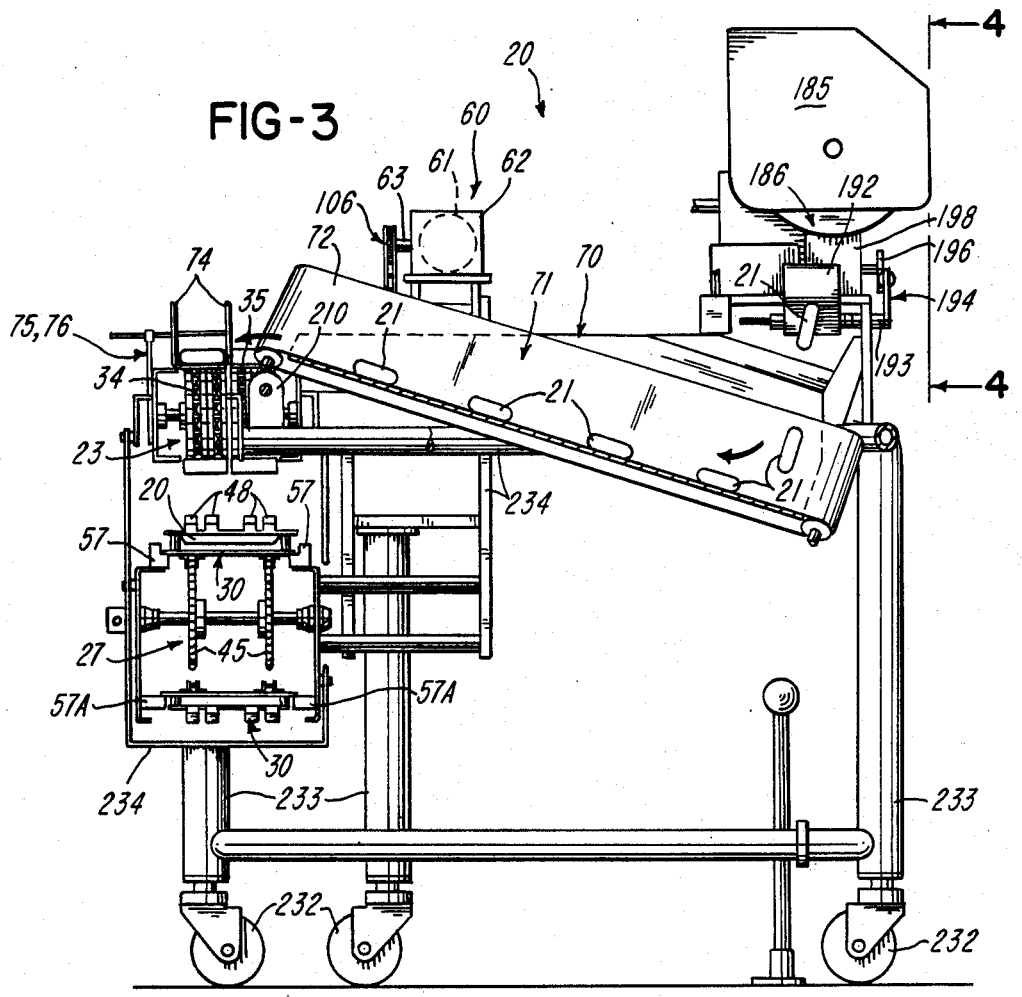
FIG. 3 is a view taken essentially on the line 3—3 of FIG. 2.

The apparatus 20 also comprises feed means (see FIGS. 1, 2 and 3) for feeding each article 21 in an associated cradle 24 and such feed means is designated generally by the reference numeral 70. The feed means 70 serves to feed each article 21 in its associated cradle 24 with the longitudinal axis of each article 21 parallel to the axis of its cradle.

The feed means 70 comprises at least one pair of cooperating conveyors and in this example of the invention comprises two pairs of cooperating conveyors and each pair is designated by the general reference numeral 71. Each pair of conveyors 71 consists of first and second conveyors 72 and 73 which are constructed and arranged to move associated articles thereon in aligned end-to-end relation and feed same in a serial manner in the L-shaped supports or cradles 24. The speed of the conveyors 72 and 73 of each pair 71 is so controlled and articles 21 are introduced into the conveyors 71 while also controlling the speed of the conveyor device 23 that all cradles 24 are filled with individual articles 21. The conveyors 72 and 73 are open mesh type endless conveyors of a type known in the art and are constructed such that they are easy to keep clean to thereby assure the food products or articles are handled in a clean hygienic manner.

Referring again to FIG. 1, it is seen that the feed means 70 also comprises stop means in the form of a pair of stops each designated by the same reference numeral 74. Each stop 74 is in the form of a vertically disposed stop plate 74 which is suitably supported on a portion of the conveyor device 23; and, one of the stops 74 is associated with articles 21 which are conveyed from one conveyor 71 into the cradles 24 of row 25 while the other stop 74 is associated with articles 21 which are conveyed from the otherconveyor 71 into cradles 24 of row 26. The stop 74 associated with row 25 is fastened to the conveyor device 23 by a suitable bracket assembly 75 while the stop 74 associated with row 26 is fastened to the conveyor device 23 by a bracket assembly 76. The stops 74 serve to limit the extent of movement of each article 21 across its associated cradle 24 and thereby assure accurate placement of the article in its cradle 24.

As previously mentioned, the apparatus 20 has transfer means 31 for transferring a predetermined number of articles 21 from the conveyor device 23 to the conveyor device 27 into the associated packages 21; and, such transfer means is illustrated best in FIG. 6. The transfer means comprises a rotatable star wheel 80 and a first plurality of cooperating stationary finger means or fingers each designated by the same reference numeral 81. The star wheel 80 has a plurality of radial arms each designated by the same reference numeral 82; and, the arms 82 extend through the stationary fingers or bars 81, as shown at 83 for example. The arms 82 cooperate with the fingers 81 to transfer articles 21 from the conveyor device 23 toward and into packages 22 carried on the conveyor device 27.

The fingers 81 are disposed in spaced parallel vertical relation and are held in such relation by a plurality of horizontally arranged transverse bars 85. The bars 85 are suitably fixed to the fingers 81 in spaced parallel relation. The fingers 81 are disposed in a substantially identical S-shaped pattern as shown in FIG. 6; and, the transverse bars 85 are fastened to the fingers 81 in such a manner that the arms 82 extend through the fingers 81 without obstruction by such fingers and without obstruction by the transverse bars 85. In this manner, each article 21 as it drops by gravity from the support provided by its cradle 24 in conveyor 23 is picked up by an associated arm 82 (which consists of a set of arms) of the star wheel 80; and, in essence, is moved gently yet rapidly toward an article pickup station 88 where a predetermined number of articles 21 (fourteen in this illustration) are picked up in a manner to be subsequently described and moved into an associated package 22.

The finger means of the transfer means 31 also comprise a second cooperating plurality of stationary fingers each designated by the same reference numeral 86. The fingers 86 are disposed in spaced parallel relation and spaced from the first-mentioned plurality of fingers 81 as shown by the typical spacing 87 in FIG. 6. The second plurality of fingers 86 cooperate with the first plurality of fingers 81 to help guide and support the articles 21 during movement thereof from the conveyor device 23 to the conveyor device 27.

The fingers 86 extend in an arcuate substantially reverse C-shaped pattern which corresponds to the lower portion of th S-shaped fingers 81 while being spaced by the spacing 87 therefrom. The fingers 86 are held together by a plurality of transverse bars each designated by the same reference numeral 86A. Thus, the finger means comprised of the fingers 81 and 86 together with the arms 82 of the star wheel 80 help support and guide the articles toward and into the pickup station 88. At pickup station 88, the members 21 are supported on lower horizontal end portions 88A of member 86.

As mentioned previously the star wheel 80 has radial arms 82 and as seen in FIG. 5 and 6 for example, the radial arms comprise sets of arms with each set having its arms disposed in a common radial plane. Further, each arm 82 of each set is adapted to extend through an associated pair of fingers 81 in a noninterfering manner; and, as mentioned earlier each radial set of arms, in essence, supports an associated article in a horizontal relation and provides movement of each article from the elevated position of the upper conveyor device 23 in this example of the invention to a position therebelow at station 88 onto portions 88A. The articles 21 are then moved into an associated package 22 carried on an associated carrier 30 carried by the conveyor device 27. At station 88 the pusher fingers 48 of each carrier 30 push and slide associated articles on portions 88A into their package 22.

As previously mentioned the drive means 33 comprises drive connections 67 to the transfer means 31; and, inasmuch as the transfer means 31 comprises the star wheel 80, the drive connections 67 provide rotation of the star wheel 80 by rotation of shaft 90 which rotatably supports such star wheel. The shaft 90 has a toothed rachet wheel 89 (FIG. 8) detachably fixed thereto and comprising the drive connection 67. The remainder of the drive connection 67 which rotate the wheel 89 will be described subsequently.

The transfer means 31 is particularly adapted to enable handling of articles 21 of different sizes. For example, in the case of elongate cylindrical articles such as sausages or like perishable food products the transfer means has means for adjusting the spacing at 87 and thus the supporting function of the fingers 81 and 86 to take into account the diameter or size of the articles 21 (FIG. 6). The above-mentioned adjusting means comprises an adjusting assembly 92 which includes a mechanical support structure 93 which includes a telescoping shaft 94 extending therefrom. The shaft 94 is suitably attached to transverse bars 85 associated with the fingers 81 and the shaft 94 may be extended or retracted, as desired, depending on the diameter or size of articles 21 to thereby move the entire assembly of fingers 81 in a rectilinear horizontal path and with great precision The adjusting assembly 92 also includes a vertically disposed rod 96 which has a threaded end 97 extending through an opening in a flange 100 which is supported by the assembly 92. With end 97 through the opening in flange 100 cooperating nuts 101 are threaded on end 97 with flange 100 sandwiched therebetween to thereby control the vertical position of the lower end 102 of rod 96, which is suitably fixed to the fingers 81. In this manner the rod 96 serves to control the position of the lower portion of the fingers 81.

The transfer means 31 has a second adjusting assembly 103 and such assembly 103 is suitably fixed in a stationary position on the apparatus 20. The assembly 103 has an adjustable rod 104 the end of which is fixed to transverse bars 86A of the fingers 81. The assembly 103 is used to move the fingers 86 in a similar manner as the assembly 92 is used to move the fingers 81 so that by providing controlled movement of the fingers 86 and fingers 81 using assemblies 103 and 92 respectively the spacing 87 is precisely controlled. The control of spacing 87 assures that articles 21 of different size may be accommodated by the transfer means in a simple and efficient manner to assure movement of such articles during packaging in a smooth unobstructed manner.

As previously mentioned the drive means 33 includes drive connections 65 to the conveyor device 23, drive connections 66 to the conveyor device 27, and drive connections 67 to the transfer means 31. The drive connections 65 to the conveyor device 23 and the drive connections to the conveyor device 27 comprise quick change means for changing the speed of at least one of the conveyor devices 23 and 27 and thereby control the predetermined number of articles 21 being transferred from the conveyor device 23 into associated packages 22 carried by the conveyor device 27. In particular, the quick change means comprise cooperating mechanical connections which enable change of speed while keeping substantially all components in assembled relation. Indeed, the only components that need to be engaged or disengaged or modified in their operating relationship comprise a plurality of pins which will be described in detail subsequently.

As best shown in FIG. 8 the drive connections 65 to the conveyor device 23 consist of a chain drive assembly 106 which comprises a sprocket wheel 107, a sprocket wheel 110 and a sprocket chain 111 operatively connected therebetween. The sprocket wheel 107 is suitably fixed to the shaft 63, and the sprocket wheel 110 is suitably fixed to a suitable shaft 112 of extended length. The shaft 112 is supported for rotation in a manner which is well known in the art.

The drive connections 65 also include a sprocket chain assembly 113 which consists of pair of sprocket wheels 114 and 115 which are suitably operatively connected by a sprocket chain 117. The sprocket wheel 114 is suitably fixed to one end of the shaft 112 and the sprocket wheel 115 is suitably fixed to a shaft 118 through which the conveyor device 23 is actually driven. In particular, the conveyor device 23 has two sets of driving sprocket wheels 119 and 120 fixed to the shaft 118. The sprocket wheels 119 and 120 drive the sprocket chain assemblies 34 and 35 respectively of the conveyor device 23.

The sprocket chain assembly 34 comprises sprocket wheels 121 at one end thereof and sprocket wheels 122 at the opposite end thereof with sprocket chains 123 operatively connected between the sprocket wheels 121 and 122. Similarly, the sprocket chain assembly 35 comprises sprocket wheels 124 at one end thereof and sprocket wheels 125 at the opposite end thereof with sprocket chains 126 operatively connected between the sprocket wheels 124 and 125. As will be readily apparent from FIG. 8 of the drawings the sprocket wheels or sprockets 121 and 124 are suitably detachably fastened to a common shaft 127. Similarly, it will be appreciated that the sprocket wheels or sprockets 125 of the sprocket chain assembly 35 are suitably detachably fastened to a common shaft 131. Likewise, the sprocket wheels or sprockets 122 of the sprocket chain assembly 34 are suitably detachably fastened to a common shaft 132. Thus, it is seen that the drive connections 65 for the conveyor device 23 consist of sprockets and sprocket chains driving from shaft 63 through shaft 112 and shaft 118.

The drive connections 66 to the conveyor device 27 may consist of any two of a plurality of sprocket chain assemblies 133, 134, 135, 136, and 137. The sprocket chain assemblies 133, 134, and 135 have sprocket wheels 140, 141, and 142 respectively suitably detachably fastened to shaft 112 at one end thereof; and, in this example such sprocket wheels 140, 141, and 142 are of equal size with the same number of teeth. The sprocket chain assemblies 133, 134, and 135 have sprocket wheels or sprockets 143, 144, and 145 respectively at the opposite end thereof and such sprockets 143, 144, and 145 are suitably detachably fastened to an associated common shaft 146. The sprocket wheels 143, 144, and 145 of this example have a different number of teeth, for example 40, 60, and 70 respectively.

The sprocket chain assemblies 136 and 137 of the drive connections 66 comprise sprocket wheels 147 and 148 suitably detachably fastened to the shaft 146 at one end; and, the sprocket chain assemblies 136 and 137 also include sprocket wheels or sprockets 151 and 152 at the opposite ends thereof with the sprockets 151 and 152 being suitably detachably fastened to a common shaft 149. The sprockets 151 and 152 have a different number of teeth and in this example of the invention such sprockets have 30 and 60 teeth respectively. The sprockets 147 and 148 of this example have the same number of teeth and in this example each has 60 teeth.

It will be appreciated that the sprocket chain assemblies 133, 134, 135, 136, and 137 have associated sprocket chains 153, 154, 155, 156, and 157 respectively. Further, the drive connections 66 to the conveyor device 27 use the sprockets 44 and such drive connections 66, in essence, comprise sprocket chain assemblies transferring power of rotary motion from shaft 63 through shaft 112, 146, and 149 by any two selected sprocket chain assemblies 133 through 137.

Figure 9:
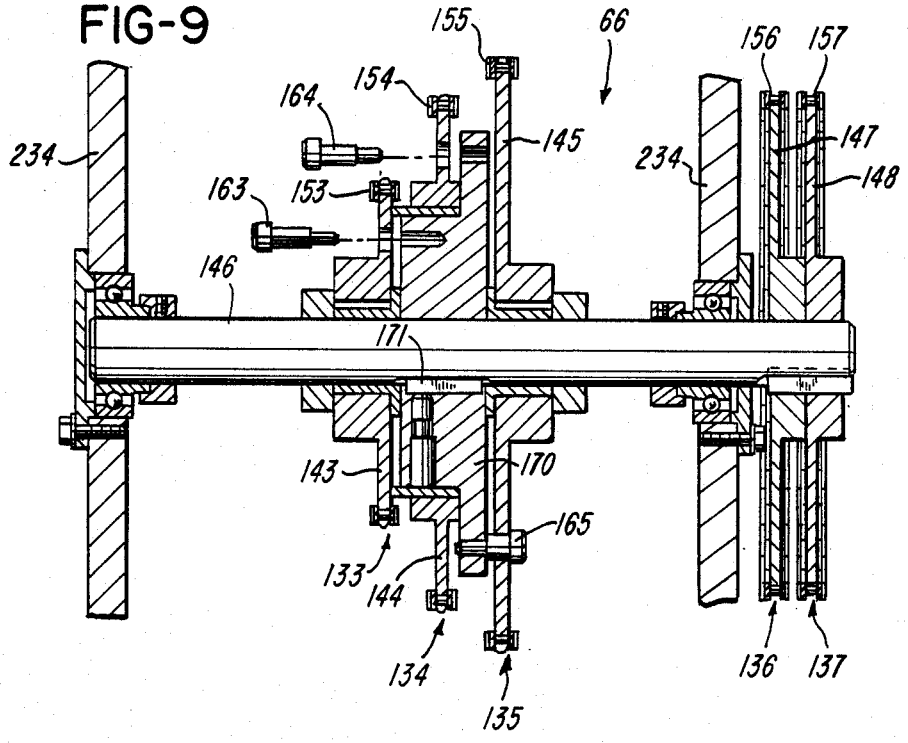
FIG. 9 is a cross-sectional view taken essentially on the line 9—9 of FIG. 2; illustrating a particular combination of drive components of the drive means being utilized in the apparatus of FIG. 1.

As previously mentioned the apparatus 20 has quick change means in the form of cooperating mechanical connections which enable change of speed of the conveyor device 27 while keeping substantially all components in assembled relation. The quick change means in this example consists of a plurality of pins (FIG. 9) in the form of a pin 163 operatively associated with the sprocket chain assembly 133, a pin 164 operatively associated with the sprocket chain assembly 134, a pin 165 operatively associated with the sprocket chain assembly 135, a pin 166 (FIG. 5) operatively associated with the sprocket chain assembly 136, and a pin 167 operatively associated with the sprocket chain assembly 137.

The quick change means of this example consists in engaging only two of the sprocket chain assemblies 133 through 137. In the illustration presented in the drawings, pin 165 serves to operatively connect the sprocket chain assembly 135 by connecting sprocket wheel 145 thereof to the shaft 146 (FIG. 9) and pin 166 (FIG. 5) operatively connects sprocket wheel assembly 136 to the shaft 149 whereby the sprocket chain assemblies 135 and 136 have been selected and in this example serve to assure that a predetermined number of 14 (fourteen) articles 21, seven from each sprocket chain assembly 34 and 35, are being packaged.

It will be appreciated that other combinations of the quick change means may be selected as desired. For example, if it had been desired to package twelve articles 21 in each package 22 then sprocket chain assemblies 134 and 136 would be engaged. Similarly, if it is desired to package eight articles 21 in each package 22 then sprocket chain assemblies 133 and 137 would be engaged. The engagement of the various sprocket chain assemblies is achieved by engaging the appropriate pins 163 through 167 as previously explained.

It will also be appreciated that while any two of the sprocket chain assemblies 133 through 137 are engaged the other three sprocket chain assemblies that are not engaged are essentially free wheeling and operate such that they do not obstruct or hinder the operation of the apparatus 20 in any manner. Further, the pins 163 through 167 which are selectively engaged employ associated hub assemblies which are suitably detachably keyed to respective shafts of the drive means 33. In particular, it will be seen that the pins 163, 164, and 165 operate through an associated hub assembly 170 which is suitably keyed to the shaft 146 by a key 171 as is known in the art. Similarly, the pins 166 and 167 operate through an associated hub assembly 172 which is in turn suitably keyed to the shaft 149 by a key 173.

Thus, it is clear that with all components of the drive means 33 substantially in their assembled relation it is a simple matter to package a predetermined number of articles and such predetermined number of articles may be varied, as desired, by the proper selection of the drive connections. In applications where sprocket wheels and sprocket chains are utilized in connection with associated shafts and the like the number of teeth of the sprocket wheels (and hence the diameters thereof) may be varied as desired and preassembled in the drive means 33 to provide not only for the combinations mentioned in this disclosure but other combinations as well which utilize additional numbers of sprocket chain assemblies so that a large selection of predetermined numbers of articles may be packaged essentially in accordance with the teachings of this invention.

It will also be appreciated that although sprocket chain assemblies are utilized in this example of the invention, the concept of providing preassembled components with means which enable quick change of the selected operating components may be achieved utilizing other means such as cooperating gears, power transmission belt drive assemblies using synchronous type belts, variable speed power transmission devices, or connections, for example, to achieve the same results described herein.

As previously mentioned, a drive connection 67 to the transfer device 31 is provided as a portion of the drive means 33. The drive connection 67 consists of a sprocket chain assembly 175 for driving the shaft 90 of the star wheel 80. The sprocket chain assembly of this example consists of a sprocket wheel or sprocket 176 suitably detachably fastened to the shaft 118, a sprocket 177 detachably fastened to an idler shaft 180, the sprocket wheel 89 which is detachably fastened to the shaft 90, and a sprocket chain 182 operatively associated with the sprockets 176, 177, and 89. Thus, it is seen that the drive connection 67 provides a driving force to the star wheel 80 and such driving is achieved through the single drive motor assembly 60 of the drive means 33 by driving through shaft 63, shaft 112, shaft 118, and shaft 90 utilizing suitable sprocket chain assemblies connected in the manner shown in FIG. 8.

It will be appreciated that the drive connection 67 to the transfer device 31 may be provided with means for changing the speed of the star wheel 80 and this may be achieved simply by changing the speed of rotation of the shaft 90. An easy way to achieve this is to simply change the size of the sprocket wheel 89. The principles utilized and described in connection with the changing of the speed of the shaft 149 utilizing the sprocket chain assemblies 133 through 137 may be fully applicable to changing the speed of the shaft 90. Likewise it will be appreciated that the speed of the shaft 112 to the conveyor device 23 may be changed while keeping all components in a substantially assembled relation with the exception of minor components such as applicable pins and again utilizing the concepts described above in connection with the selective coupling of two of the sprocket chain assemblies 133 through 137.

Referring again to FIG. 1 it is seen that the apparatus 20 comprises feed means 70 which was described, in part, previously in this disclosure. The feed means 70 comprises conveyor means in the form of a pair of cooperating conveyor devices each designated by the same reference numeral 71. The operation of the conveyor devices 71 was described previously.

Figure 4:
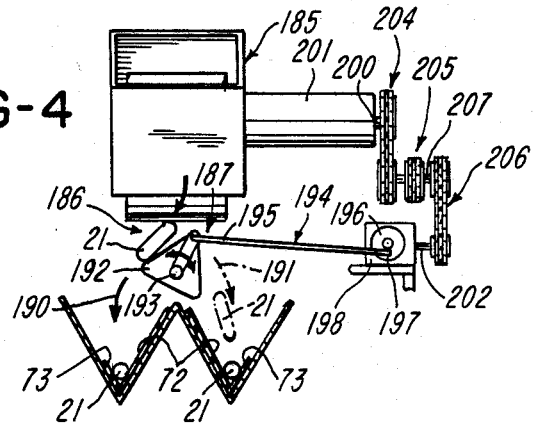
FIG. 4 is a view taken essentially on the line 4—4 of FIG. 3.

In addition to the conveyor devices 71, the feed means 70 may be considered as being comprised of supply means or a supply for the articles 21 and such supply means is designated generally by the reference numeral 185. The article supply means 185 comprises means for providing articles 21 in a steady rectilinear stream thereof as shown at 186 in FIG. 4, and an article diverting assembly 187 for diverting articles 21 from the steady rectilinear stream thereof into a pair of paths shown as paths 190 and 191. The diverting assembly is comprised of a triangular member 192 suitably pivotally supported on a shaft 193 and having a linkage assembly 194 which pivots the triangular member 192, about its shaft 193 diverting articles first into path 190 and then into path 191 so as to dispose articles 21 into both conveyors 71 in a sequential manner.

The linkage assembly includes a link 195 pivotally fastened to the member 192 and a rotatable wheel 196 which has means for attaching the link 195 thereto in an eccentric manner as shown at 197. Thus, upon rotating the wheel 196 triangular member 192 is pivoted back and forth to thereby move articles 21 from the rectilinear stream 186 thereof into the paths 190 and 191 in an alternating manner. The wheel 196 is driven by a gear box assembly 198 which in turn is driven from a shaft 200 extending from a gear box assembly 201 comprising the article supply means 185. The gear box 198 has a shaft 202 extending therefrom and rotary power is transmitted from the shaft 200 to the shaft 202 through a plurality of three chain drive assemblies 204, 205, and 206 which have a common shaft 207 and in a manner known in the art. The assemblies 204 through 206 have the usual known sprockets and chains and it will be appreciated that instead of sprocket chain assemblies 204, 205, and 206 other mechanical drive connections may be provided, if desired.

In this disclosure of the invention the article supply means 185 is preferably in the form of an article forming means and in the case of articles such as sausages, or the like, the article supply means or forming means 185 consists of a sausage forming apparatus. The sausage forming apparatus may be of any suitable type known in the art.

In this disclosure of the invention the feed means 70 comprise cooperating sets of conveyors 71 with each set of cooperating conveyors 71 being comprised of conveyors 72 and 73 as previously described. As seen in FIG. 8, each set of conveyors 71 is driven by an associated gear box assembly 210 and each gear box assembly 210 drives an associated drive roller 211 of a conveyor 72 and a drive roller 212 of a conveyor 73. The opposite ends of the conveyors 72 and 73 have idler rollers 214 and 215 respectively. The gear box assemblies 210 are driven by a shaft 216 extending from a gear box 217 extending from the power train portion of the forming device 185 and a suitable mechanical linkage 220 interconnects shaft 216 with one of the gear boxes 210. A mechanical assembly 221 comprised of gears and shafts interconnects the previously mentioned gear box 210 with the other gear box 210.

Thus, the same drive motor or a single drive motor assembly 60 comprising the drive means 33 may provide power for the feed means 70 through power to the forming device 185 via drive connection or shaft 64. The shaft 64 may be a flexible shaft operatively connected between drive motor assembly 60 and gear box 201 of the forming device 185.

It will also be appreciated that instead of utilizing a single drive motor assembly 60 for the conveyor devices 23 and 27, the forming device 185, and feed means 70 it may be desirable to provide separate drive motors for selected components. For example, the motor assembly 60 may be used to drive the conveyor devices 23 and 27 and a separate motor for the forming device 185. In instances where separate drives are used the applicable motors are suitably synchronized to provide the desired operation so as to enable packaging of articles 21 in a continuous non+indexing and uninterrupted manner.

In addition, the gear box 217 used to drive the conveyor devices 71 instead of being provided as a portion of the forming device 185 may be provided and suitably operatively connected to a drive motor which may be in the form of an electric drive motor 222 using a drive connection which is shown schematically by dot-dash lines 223.

As seen in FIG. 1, the apparatus 20 is preferably provided with a suitable control panel 225 and suitable control buttons 226 thereon for controlling the operation of the drive means 33. In addition, it will be appreciated that the apparatus 20 may also have an emergency stop switch 230 which is suitably operatively connected to the drive means 33 through a suitable electrical conduit 231 and other suitable connections (not shown) to provide emergency stopping of all components.

The apparatus 20 may be in the form of a stationary apparatus which is suitably fixed in position on any supporting floor therefor. However, such apparatus is preferably in the form of a movable or portable apparatus 20 and for this purpose it will be seen that the apparatus is mounted on rollers 232 (FIG. 1) which are rotatably mounted on support columns 233 which in turn are fixed to a main frame structure 234. Thus, the entire apparatus 20 shown in FIG. 1 is portable and readily movable from location to location within an article manufacturing facility.

Figure 10:
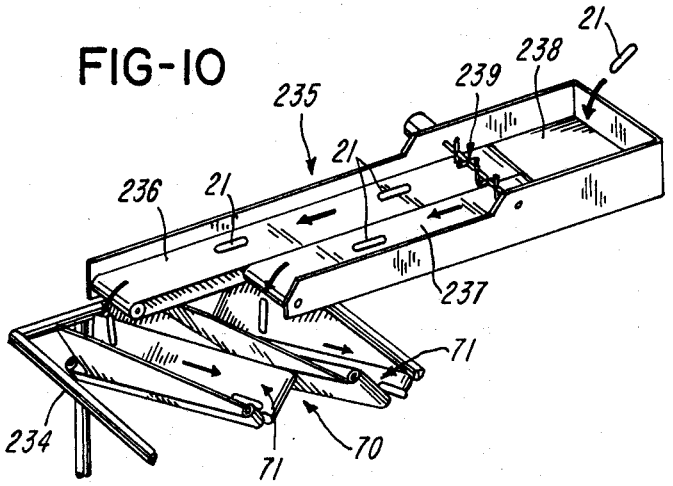
FIG. 10 is a fragmentary isometric view showing a modification of the apparatus of this invention which utilizes a different form of supply means for its feed means.

In this disclosure of the invention the article supply means is shown in the form of a forming device 185. However, reference is now made to FIG. 10 of the drawings which shows a modification of the article supply mean in the form of a supply chute assembly 235. The supply chute assembly 235 comprises a pair of conveyors 236 and 237 which are operatively associated with a supply bin 238. The bin 238 receives a mass of jumbled articles 21 and such articles are suitably moved from such supply bin 238 and unscrambled by an unscrambling device 239 of a type well known in the art; and, the articles 21 are then introduced and moved along the conveyors 236 and 237. The articles 21 move from their respective conveyors 236 and 237 onto an associated one of the conveyor devices 71. After introduction of articles 21 onto the conveyor devices 71 the operation of the apparatus 20 is the same as previously described and such description will not be repeated.

In this disclosure of the invention various shafts, sprockets, conveyors, and the like and other mechanical structures have been shown and described and in many instances without a detailed description of supports, bearing means, and other associated structures and components which are associated therewith. However, it will be appreciated that such supports, bearing means, and the like are of any suitable type known in the art and thus need not be described in detail inasmuch as they do not comprise a part of this invention.

The apparatus 20 is particularly adapted to handle food products in a minimum of time generally of the order of 30 seconds and thereby enable processing of articles 21 such as tender food products which are ordinarily prone to being mashed, mangled, and the like, with optimum speed and yet without damage thereto. In addition, it will be appreciated that the components comprising the apparatus and in particular the components which come into contact with the food articles 1 are made of materials which are readily cleaned utilizing suitable cleaners known in the art and yet without damage to the operating components.

Indeed, the materials comprising the various components of the apparatus 20 may be metallic materials, plastic materials, or any combination of these materials and other materials as are known in the art.

In this disclosure of the invention the package means or packages 22 have been described as being in the form of trays. However, it is to be understood that the package means need not necessarily be trays but may be sheets within which a predetermined number of articles may be placed, supported, and confined. In addition, it will be appreciated that whether packages 22 or sheets 22 are utilized such packages are of the type that may be readily stacked in cartons or boxes therefor for transportation and/or storage.

The various conveyor devices utilized herein may have suitable takeup mechanisms (not shown) so as to assure operation of such conveyor devices with optimum efficiency. Indeed, in the case of sprockets and sprocket chains the takeup mechanisms are such that the sprocket chains are kept at optimum tension and as is known in the art.

Terms such as upper, lower, above, below, and the like have been used throughout this disclosure for ease of presentation and to describe the construction and arrangement of components as illustrated in the drawings. However, it is to be understood that these terms are not to be considered as limiting in any way.

While present exemplary embodiments of this invention, and methods of practicing the same, have been illustrated and described, it will be recognized that this invention may be otherwise variously embodied and practiced within the scope of the following claims.

What is claimed is:

1. In an apparatus for packaging articles of roughly equal size in package means therefor comprising, first conveyor means for said articles, said first conveyor means having a plurality of receptacles each for receiving and supporting an individual one of said articles, second conveyor means for sequentially moving a plurality of package means in a first plane for receiving said articles, and transfer means for transferring a predetermined number of said articles from said first conveyor means into associated package means, the improvement wherein initially each of said receptacles provides the total support and movement of an associated one of said articles including movement in a vertical transfer zone during a first portion of substantially vertically downward movement between said first and second conveyors before said transfer means provides total support thereof, said transfer means comprises means which maintains said articles separate from each other until said articles are in a second plane disposed above and parallel to said first plane, said transfer means accumulated articles in said second plane until said predetermined number have been accumulated, said first and second conveyor means have portions thereof in parallel facing relation, and said apparatus further comprises drive means for operating said conveyor means in a continuous non-indexing manner to thereby continuously package said predetermined number of articles in an associated package means.

2. An apparatus as set forth in claim 1 in which said transfer means comprises means for transferring said predetermined number of articles from said second plane into planar relation into its associated package means in said first plane.

3. An apparatus as set forth in claim 1 in which said conveyor means have said portions thereof disposed in parallel horizontal relation.

4. An apparatus as set forth in claim 3 in which said portion of said first conveyor means is disposed vertically above said portion of said second conveyor means.

5. An apparatus as set forth in claim 1 in which said drive means includes means for also operating said transfer means in a continuous non-indexing manner.

6. An apparatus as set forth in claim 5 in which said drive means comprises a single drive motor and drive connections from said motor to said first conveyor means, second conveyor means, and transfer means.

7. An apparatus as set forth in claim 6 in which said drive connections to said first conveyor means and to said second conveyor means comprise quick change means for changing the speed of at least one of said first and second conveyor means and thereby control said predetermined number.

8. An apparatus as set forth in claim 7 in which said quick change means comprise cooperating mechanical connections which enable change of said speed while keeping substantially all components of said mechanical connections in assembled relation.

9. An apparatus as set forth in claim 1 in which said second conveyor means comprises a second chain conveyor having a plurality of spaced carriers attached thereto in equally spaced relation for movement therewith, each of said carriers being adapted to carry an associated one of said package means.

10. An apparatus as set forth in claim 1 in which said first conveyor means comprises a first chain conveyor, and each of said receptacles comprises a roughly L-shaped support.

11. An apparatus as set forth in claim 10 in which each L-shaped support has a pair of legs defined by a first planar leg and a second leg provided with an integral ridge disposed parallel to said first leg, said ridge serving to help minimize the amount of contact of said article with said second leg.

12. An apparatus as set forth in claim 10 in which each of said package means is in the form of a tray.

13. An apparatus as set forth in claim 12 in which each carrier has a cutout therein which is adapted to receive an associated tray in nested relation therewithin.

14. An apparatus as set forth in claim 10 in which each of said articles is an elongate article having a longitudinal axis, each L-shaped support has an axis disposed perpendicular to the direction of movement of said first conveyor and further comprising feed means for feeding each article in an associated L-shaped support with its longitudinal axis parallel to the axis of its L-shaped support.

15. An apparatus as set forth in claim 14 in which said feed means comprises supply means for said articles, said supply means comprising a supply bin and means for disposing said articles from said supply bin into said L-shaped supports.

16. An apparatus as set forth in claim 14 in which said first conveyor means also comprises a second chain conveyor supported alongside said first chain conveyor in parallel relation therewith, said plurality of L-shaped supports are disposed in two parallel rows consisting of a first row associated with said first chain conveyor and a second row associated with said second chain conveyor, and said feed means comprises a first pair of cooperating conveyors associated with said first chain conveyor and a second pair of cooperating conveyors associated with said second chain conveyor, each pair of cooperating conveyors of said feed means being adapted to feed articles in its associated L-shaped supports.

17. An apparatus as set forth in claim 14 in which said feed means comprises supply means for said articles, said supply means comprising means for forming said articles and feeding same in a serial manner into said L-shaped supports.

18. An apparatus as set forth in claim 17 in which said means for forming comprises means for forming a fresh tender food product which is prone to break up if handled improperly.

19. An apparatus as set forth in claim 14 in which said feed mcans comprises a pair of cooperating conveyors which are constructed and arranged to move said articles in aligned end-to-end relation and feed same in said serial manner in said L-shaped supports.

20. An apparatus as set forth in claim 19 and further comprising stop means associated with said pair of cooperating conveyors while being disposed on the side of said first conveyor remote from said feed means, said stop means serving to limit the extent of movement of each article across its associated L-shaped support and thereby assure accurate placement thereof in the associated L-shaped support.

21. An apparatus as set forth in claim 20 in which said pair of cooperating conveyors are open mesh conveyors and each of said stop means comprises a stop plate.

22. An apparatus as set forth in claim 1 in which said transfer means comprises a rotatable star wheel and cooperating stationary finger means, said star wheel having a plurality of radial arms which are adapted to extend through said finger means and cooperate therewith to transfer said articles.

23. In an apparatus for packaging articles of roughly equal size in package means therefor comprising, first conveyor means for said articles, said first conveyor means having a plurality of receptacles each for receiving and supporting an individual one of said articles, second conveyor means for sequentially moving a plurality of package means in a first plane for receiving said articles, and transfer means for transferring a predetermined number of said articles from said first conveyor means into associated package means, the improvement wherein initially each of said receptacles provides the total support and movement of an associated one of said articles including movement in a vertical transfer zone during a first portion of substantially vertically downward movement between said first and second conveyors before said transfer means provides total support thereof, said transfer means comprises means which maintains said articles separate from each other until said articles are in a second plane disposed above and parallel to said first plane, said transfer means accumulates articles in second plane until said predetermined number have been accumulated, said means of said transfer means which maintains said articles separate comprises a rotatable star wheel and cooperating stationary finger means, said star wheel having a plurality of radial arms which are adapted to extend through said finger means and cooperate therewith to transfer said articles into said second plane.

24. An apparatus as set forth in claim 23 in which said first and second conveyor means have portions thereof in parallel horizontal facing relation.

25. An apparatus as set forth in claim 24 and further comprising means operating said conveyor means in a continuous non-indexing manner to thereby continuously package said predetermined number of articles in an associated package means.

26. An apparatus as set forth in claim 25 in which said finger means comprise a plurality of fingers disposed in spaced parallel relation, said radial arms comprise sets of arms with each set having its arms disposed in a common radial plane and with each arm of each set being adapted to extend through an associated pair of fingers.

27. An apparatus as set forth in claim 26 in which said fingers are disposed in substantially identical S-shaped patterns.

28. An apparatus as set forth in claim 27 in which said conveyor means have portions thereof disposed in parallel horizontal relation with said portion of said first conveyor means disposed vertically above said portion of said second conveyor means.

29. An apparatus as set forth in claim 28 in which said S-shaped fingers serve to help guide and support said articles during movement thereof from an elevated position of said first conveyor means to a position therebelow into package means of said second conveyor means.

30. An apparatus as set forth in claim 29 in which said finger means comprise a cooperating second plurality of fingers disposed in spaced parallel relation and spaced from said first mentioned plurality of fingers, said second plurality of fingers cooperating with said first plurality to help guide and support said articles during movement thereof from said first conveyor means to said second conveyor means.

31. In a method of making an apparatus for packaging articles of roughly equal size in package means therefor, said method comprising the steps of providing first conveyor means for said articles, attaching on said first conveyor means a plurality of receptacles each for receiving and supporting an individual one of said articles, providing second conveyor means for sequentially moving a plurality of package means in a first plane for receiving said articles, and providing transfer means for transferring a predetermined number of said articles from said first conveyor means into associated package means, the improvement in said method wherein initially each of said receptacles provides the total support and movement of an associated one of said articles including movement in a vertical transfer zone during a first portion of substantially vertically downward movement between said first and second conveyors before said transfer means provides total support thereof, said step of providing transfer means comprises providing means of said transfer means which maintains said articles separate from each other until said articles are in a second plane disposed above and parallel to said first plane, said transfer means operating to accumulate articles in said second plane until said predetermined number have been accumulated, said steps of providing first and second conveyor means comprise providing said first and second conveyor means with portions thereof in parallel facing relation, and said method comprising the further step of providing drive means for operating said conveyor means in a continuous non-indexing manner to thereby continuously package said predetermined number of articles in an associated package means.

32. In a method of making an apparatus for packaging articles of roughly equal size in package means therefor, said method comprising the steps of providing first conveyor means for said articles, attaching on said first conveyor means a plurality of receptacles each for receiving and supporting an individual one of said articles, providing second conveyor means for sequentially moving a plurality of package means in a first plane for receiving said articles, and providing transfer means for transferring a predetermined number of said articles from said first conveyor means into associated package means, the improvement in said method wherein initially each of said receptacles provides the total support and movement of an associated one of said articles including movement in a vertical transfer zone during a first portion of substantially vertically downward movement between said first and second conveyors before said transfer means provides total support thereof, said step of providing transfer means comprises providing means of said transfer means which maintains said articles separate from each other until said articles are in a second plane disposed above and parallel to said first plane, said transfer means operating to accumulate articles in said second plane until said predetermined number have been accumulated, said step of providing means of said transfer means comprises the steps of providing a rotatable star wheel and providing cooperating stationary finger means for operation with said star wheel, said step of providing said star wheel comprises providing said star wheel having a plurality of radial arms which are adapted to extend through said finger means and cooperate therewith to transfer said articles into said second plane.

* * * * *